US011408205B2

(12) United States Patent
Piirainen et al.

(10) Patent No.: US 11,408,205 B2
(45) Date of Patent: Aug. 9, 2022

(54) ELECTROMECHANICAL LOCK

(71) Applicant: iLOQ Oy, Oulu (FI)

(72) Inventors: Mika Piirainen, Oulu (FI); Mauri Arvola, Oulu (FI)

(73) Assignee: ILOQ OY, Oulu (FI)

( * ) Notice: Subject to any disclaimer, the term of this patent is extended or adjusted under 35 U.S.C. 154(b) by 316 days.

(21) Appl. No.: 16/759,854

(22) PCT Filed: Oct. 16, 2018

(86) PCT No.: PCT/EP2018/078162
§ 371 (c)(1),
(2) Date: Apr. 28, 2020

(87) PCT Pub. No.: WO2019/086240
PCT Pub. Date: May 9, 2019

(65) Prior Publication Data

US 2020/0308873 A1 Oct. 1, 2020

(30) Foreign Application Priority Data

Nov. 2, 2017 (EP) ..... 17199658

(51) Int. Cl.
*E05B 47/06* (2006.01)
*E05B 15/00* (2006.01)
*E05B 47/00* (2006.01)

(52) U.S. Cl.
CPC ..... *E05B 47/0657* (2013.01); *E05B 15/0073* (2013.01); *E05B 47/0012* (2013.01);
(Continued)

(58) Field of Classification Search
CPC ..... Y10T 70/7057; Y10T 70/7062; Y10T 70/7068; Y10T 70/7102; Y10T 70/7107;
(Continued)

(56) References Cited

U.S. PATENT DOCUMENTS 3,733,861 A * 5/1973 Lester ..... G07C 9/00944 70/277
5,265,452 A * 11/1993 Dawson ..... E05B 47/0688 70/277

(Continued)

FOREIGN PATENT DOCUMENTS

CN 2623812 Y 7/2004
CN 102400608 4/2012

(Continued)

OTHER PUBLICATIONS

International Search Report for PCT/EP2018/078162 dated Dec. 4, 2018, 2 pages.

(Continued)

*Primary Examiner* — Lloyd A Gall
(74) *Attorney, Agent, or Firm* — Nixon & Vanderhye PC

(57) ABSTRACT

Electromechanical lock. Actuator (103) comprises drive head (109) rotatable by electric power (160). Access control mechanism (104) comprises driven gear (101) with cogs, and grip mechanism (111). Drive head (109) comprises two pins (210, 212) configured and positioned so that one of pins (210, 212) is in notch between two cogs (220, 222, 224, 226, 228) of driven gear (101). For opening, drive head (109) rotates driven gear (101) to open position (400), by two pins (210, 212) driving cogs (220, 222, 224, 226, 228) and overcoming grip mechanism (111), and thereby setting access control mechanism (104) to be rotatable (152) by user. If external mechanical break-in force (172) is applied, drive head (109) remains stationary by at least one of pins (210, 212) contacting at least one of cogs (220, 222, 224), and by grip mechanism (111) holding driven gear (101) stationary in locked position (200).

4 Claims, 5 Drawing Sheets

(52) U.S. Cl.
CPC ..... *E05B 47/0038* (2013.01); *E05B 47/0611* (2013.01); *E05B 2047/002* (2013.01); *E05B 2047/0058* (2013.01); *E05B 2047/0062* (2013.01); *E05B 2047/0064* (2013.01)

(58) Field of Classification Search
CPC ..... Y10T 70/7079; Y10T 70/5681; Y10T 292/11; Y10T 292/1018; Y10T 292/1021; E05B 47/0657; E05B 15/0073; E05B 47/0012; E05B 47/0038; E05B 47/0611; E05B 2047/002; E05B 2047/0058; E05B 2047/0062; E05B 2047/0064; E05B 15/00; E05B 2047/0021
See application file for complete search history.

(56) References Cited

U.S. PATENT DOCUMENTS

| | | | | |
|---|---|---|---|---|
| 5,881,589 | A * | 3/1999 | Clark | E05B 47/0012 70/333 R |
| 8,899,081 | B2 * | 12/2014 | Pukari | E05B 47/0012 70/283.1 |
| 10,443,269 | B2 * | 10/2019 | Piirainen | H02K 49/104 |
| 2010/0180649 | A1 * | 7/2010 | Harvey | E05B 49/00 70/277 |
| 2016/0160531 | A1 * | 6/2016 | Piirainen | E05B 47/0012 74/411.5 |

FOREIGN PATENT DOCUMENTS

| | | |
|---|---|---|
| CN | 104379857 | 2/2015 |
| CN | 206397292 U | 8/2017 |
| EP | 0 730 511 | 9/1996 |
| EP | 0 906 996 | 4/1999 |
| EP | 1 746 229 | 6/2006 |
| EP | 2 813 647 | 12/2014 |
| EP | 2 971 415 | 1/2016 |
| EP | 3 118 977 | 1/2017 |
| JP | 47-009518 | 4/1972 |
| JP | 01-247669 | 10/1989 |
| JP | 09-501112 | 2/1997 |
| JP | 3045384 | 11/1997 |
| JP | 2003-138804 | 5/2003 |
| JP | 2015-001137 | 1/2015 |

OTHER PUBLICATIONS

Written Opinion of the ISA for PCT/EP2018/078162 dated Dec. 4, 2018, 5 pages.
Office Action dated Nov. 3, 2020 in corresponding Chinese Application No. 201880069944.0 (with English-language translation), 10 pages.
Office Action dated Feb. 19, 2021 in corresponding Indian Application No. 202017019084 (with English-language translation), 7 pages.
Office Action dated May 26, 2021 in corresponding Japanese Application No. 2020524110 (with English-language translation), 7 pages.

* cited by examiner

ELECTROMECHANICAL LOCK

This application is the U.S. national phase of International Application No. PCT/EP2018/078162 filed Oct. 16, 2018 which designated the U.S. and claims priority to EP Patent Application No. 17199658.0 filed Nov. 2, 2017, the entire contents of each of which are hereby incorporated by reference.

FIELD

The invention relates to an electromechanical lock.

BACKGROUND

Electromechanical locks are replacing traditional locks. Further refinement is needed for making the electromechanical lock to consume as little electric energy as possible, and/or improving the break-in security of the electromechanical lock, and/or simplifying the mechanical structure of the electromechanical lock.

EP 2813647 describes an electromechanical lock.

BRIEF DESCRIPTION

The present invention seeks to provide an improved electromechanical lock.

According to an aspect of the present invention, there is provided an electromechanical lock as specified in claim 1.

LIST OF DRAWINGS

Figure 1:
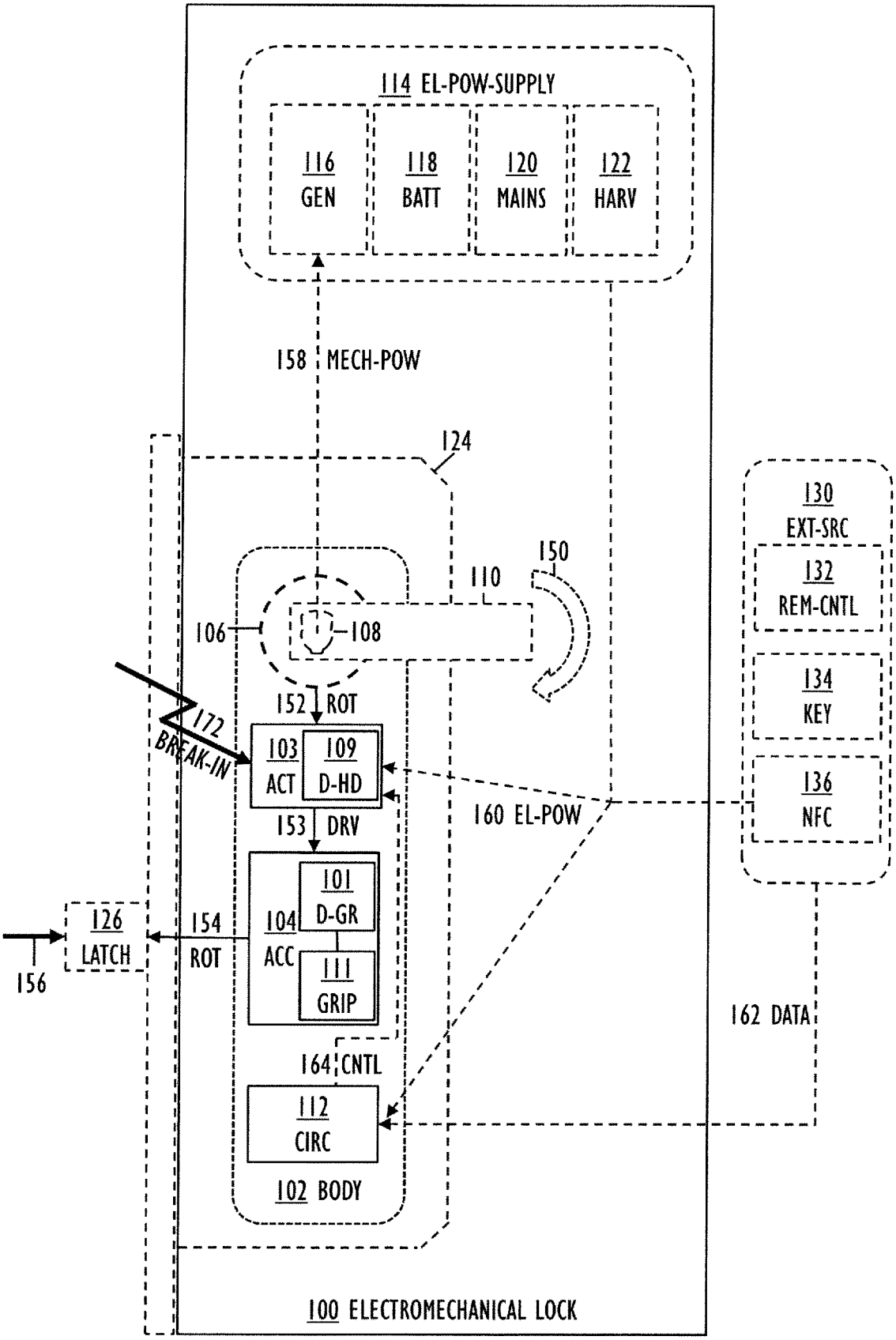

Example embodiments of the present invention are described below, by way of example only, with reference to the accompanying drawings, in which FIG. 1 illustrates example embodiments of an electromechanical lock;

FIGS. 2, 3A, 3B, 3C, 3D, 4A, 4B and 5 illustrate example embodiments, of a drive head and a driven gear; and FIGS. 6A, 6B, 6C, 7A, 7B and 7C illustrate further example embodiments of the electromechanical lock.

DESCRIPTION OF EMBODIMENTS

The following embodiments are only examples. Although the specification may refer to "an" embodiment in several locations, this does not necessarily mean that each such reference is to the same embodiment(s), or that the feature only applies to a single embodiment. Single features of different embodiments may also be combined to provide other embodiments. Furthermore, words "comprising" and "including" should be understood as not limiting the described embodiments to consist of only those features that have been mentioned and such embodiments may contain also features/structures that have not been specifically mentioned.

The Applicant, iLOQ Oy, has invented many improvements for the electromechanical locks, such as those disclosed in various EP and US patent applications/patents, incorporated herein as references in all jurisdictions where applicable. A complete discussion of all those details is not repeated here, but the reader is advised to consult those applications.

Let us now turn to FIGS. 1, 6A, 6B, 6C, 7A, 7B and 7C, which illustrate example embodiments of an electromechanical lock 100, but with only such parts shown that are relevant to the present example embodiments.

The electromechanical lock 100 comprises an electronic circuit 112 configured to read data 162 from an external source 130 and match the data 162 against a predetermined criterion. In an example embodiment, besides reading, the electronic circuit 112 may also write data to the external source 130.

The electromechanical lock 100 also comprises an actuator 103 comprising a drive head 109 rotatable by electric power 160.

The electromechanical lock 100 also comprises an access control mechanism 104 comprising a driven gear 101 with cogs, and a grip mechanism 111 holding the driven gear 101 stationary in a locked position.

The access control mechanism 104 is configured to be rotatable 152 by a user.

Figure 2:
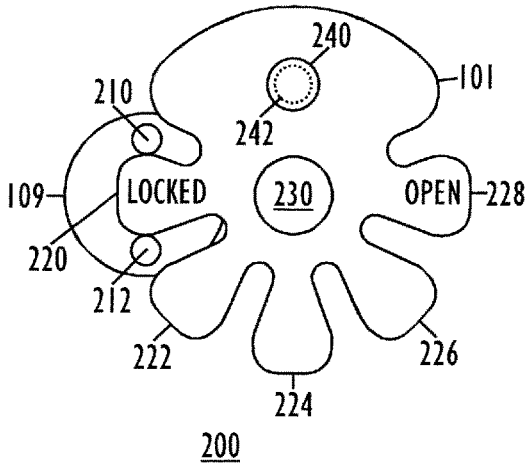

As shown in FIG. 2, the drive head 109 comprises two pins 210, 212 configured and positioned so that one of the pins 210, 212 is in a notch between two cogs 220, 222, 224, 226, 228 of the driven gear 101.

Provided that the data 162 matches the predetermined criterion, the drive head 109 rotates the driven gear 101 to an open position 400, by the two pins 210, 212 driving the cogs 220, 222, 224, 226, 228 and overcoming the grip mechanism 111, and thereby setting the access control mechanism 104 to be rotatable 152 by a user. The driven gear 101 may rotate around an axis 230.

If an external mechanical break-in force 172 is applied from outside of the electromechanical lock 100, the drive head 109 remains stationary by at least one of the pins 210, 212 contacting at least one of the cogs 220, 222, 224, and by the grip mechanism 111 holding the driven gear 101 stationary in the locked position 200.

In an example embodiment, the external mechanical break-in force 172 is generated during an unauthorized entry attempt, by subjecting the electromechanical lock 100 to hammer blows or vibration caused by another tool, for example.

In an example embodiment illustrated in FIG. 2, the cogs 220, 222, 224, 226, 228 cover a limited sector less than 360 degrees of the driven gear 101. The actuator 103 is configured to rotate the drive head 109 from the locked position 200 to the open position 400 so that the drive head 109 rotates the driven gear 101 from one end LOCKED of the limited sector to the other end OPEN of the limited sector.

Figure 5:
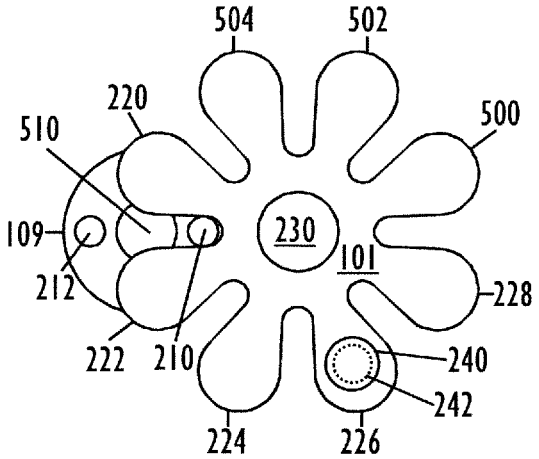
Figure 6A:
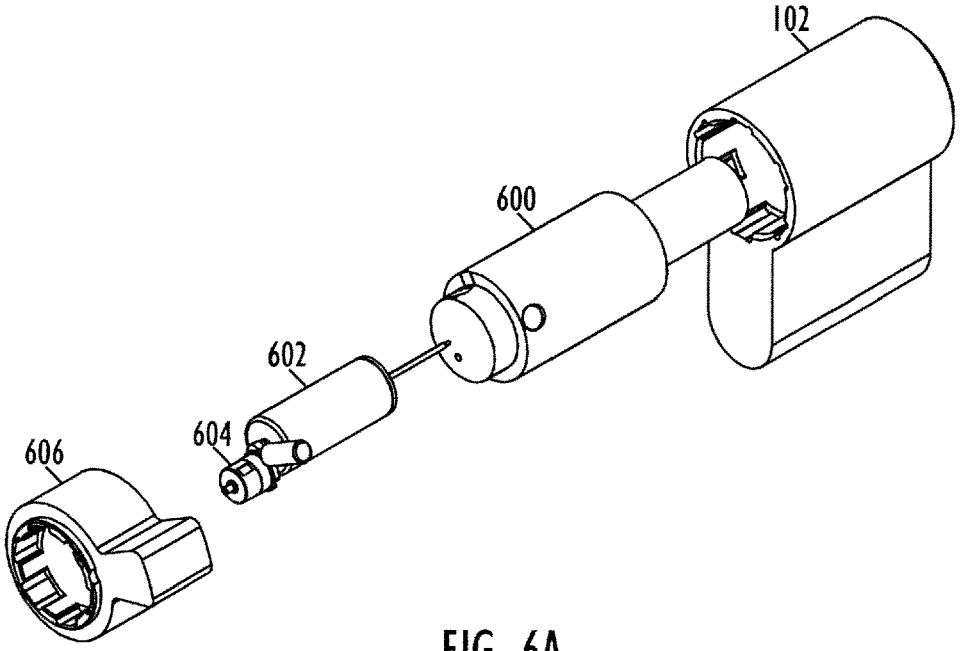
Figure 6B:
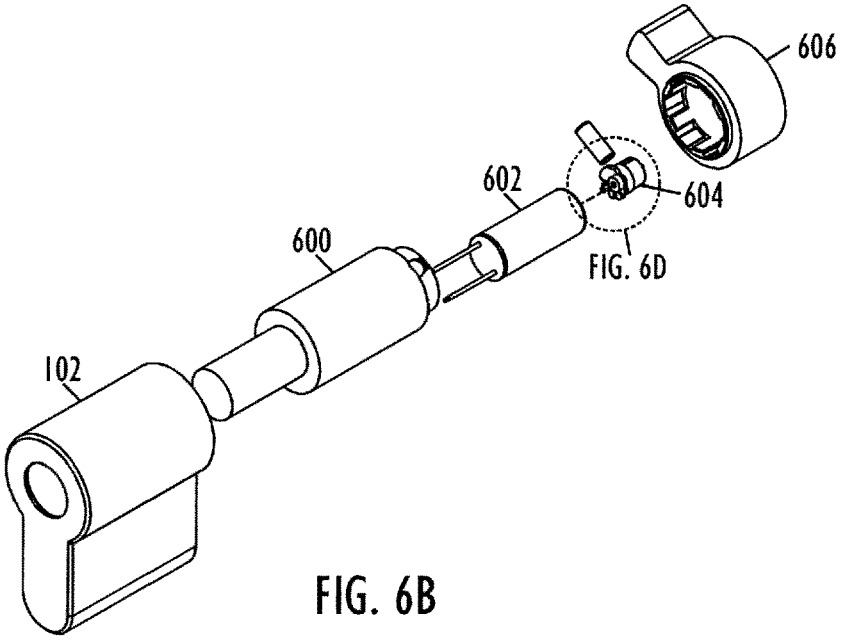
Figure 6C:
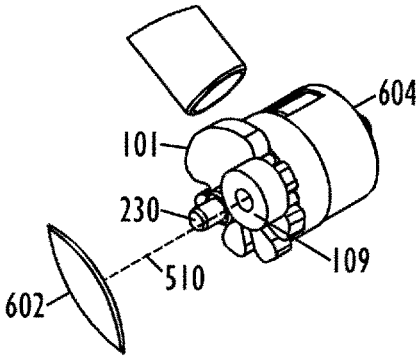
Figure 7A:
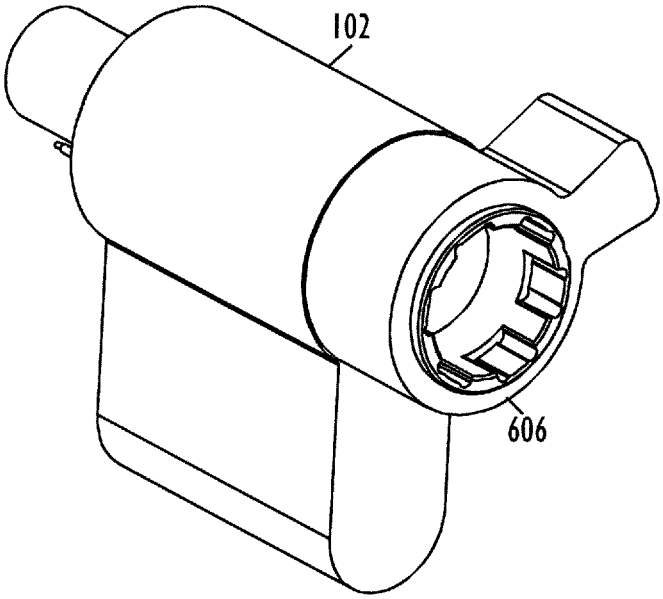
Figure 7B:
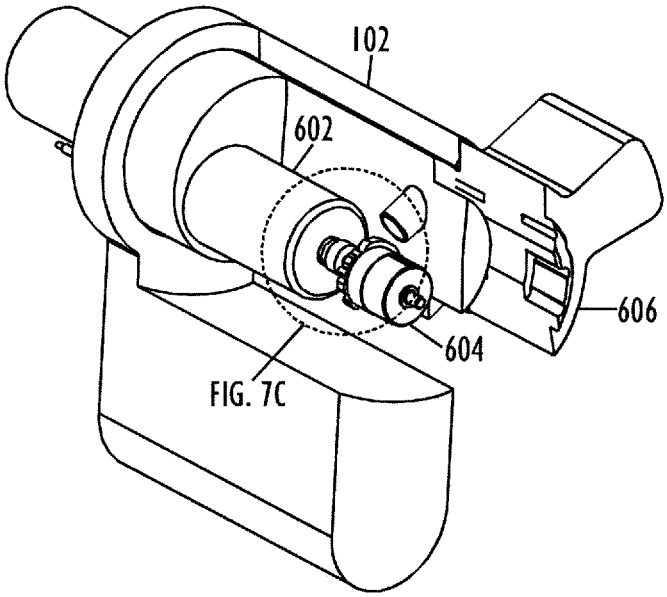
Figure 7C:
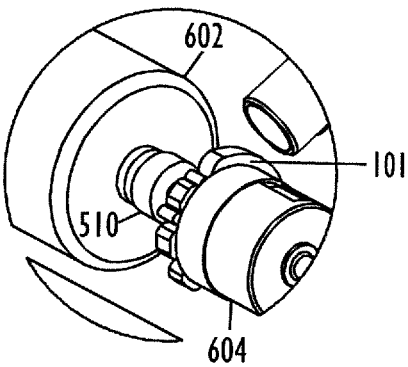

In an alternative example embodiment illustrated in FIG. 5, the cogs 220, 222, 224, 226, 228, 500, 502, 504 cover 360 degrees of the driven gear 101, and the actuator 103 is configured to rotate the drive head 109 from the locked position 200 to the open position 400 so that the drive head 109 rotates the driven gear 101 one or more times around the 360 degrees.

Figure 3A:
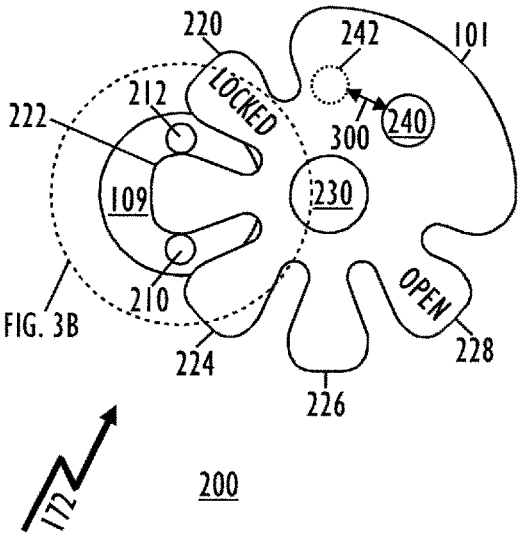
Figure 3B:
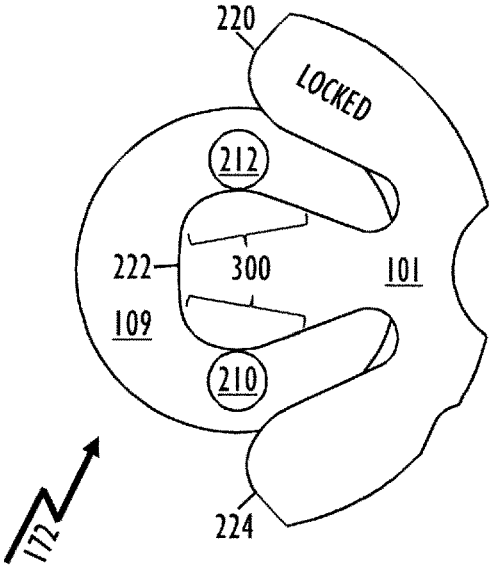

In an example embodiment illustrated in FIGS. 2, 3A and 5, the grip mechanism 111 comprises one or more permanent magnets 240 attached to the driven gear 101, and one or more counterpart permanent magnets 242 attached to an immovable part (such a lock body 102) of the electromechanical lock 100, and the overcoming of the grip mechanism 111 comprises overcoming the magnetic field forces 300 between the one or more permanent magnets 240 and the one or more counterpart permanent magnets 242.

The permanent magnets 240, 242 are positioned so that they attract each other. With pole naming conventions, the North pole N and the South pole S: the opposite poles (S-N) attract each other, whereas similar poles (N-N or S-S) repel each other. Consequently, opposite poles of the permanent magnets 240, 242 are positioned to face each other.

With this example embodiment, the grip mechanism 111 may be implemented by selecting suitable stock permanent magnets with appropriate magnetic fields and forces. A permanent magnet is an object made from a material that is magnetized and creates its own persistent magnetic field. Additionally, or instead of, two polymagnets incorporating correlated patterns of magnets programmed to simultaneously attract and repel may be used as the one or more permanent magnets 240 and the one or more counterpart permanent magnets 242. By using a polymagnet, stronger holding force and shear resistance may be achieved. Additionally, correlated magnets may be programmed to interact only with other magnetic structures that have been coded to respond.

In an example embodiment shown in FIG. 1, the electronic circuit 112 electrically controls 164 the access control mechanism 104.

In an example embodiment, an electric power supply 114 powers 160 the actuator 103 and the electronic circuit 112.

In an example embodiment, the electric energy 160 is generated in a self-powered fashion within the electromechanical lock 100 so that the electric power supply 114 comprises a generator 116.

In an example embodiment, rotating 150 a knob 106 may operate 158 the generator 116.

In an example embodiment, pushing down 150 a door handle 110 may operate 158 the generator 116.

In an example embodiment, rotating 150 a key 134 in a keyway 108, or pushing the key 134 into the keyway 108, may operate 158 the generator 116.

In an example embodiment, rotating 150 the knob 106, and/or pushing down 150 the door handle 110, and/or rotating 150 the key 134 in the keyway 108 may mechanically affect 152, such as cause rotation of, the access control mechanism 104 (via the actuator 103).

In an example embodiment, the electric power supply 114 comprises a battery 118. The battery 118 may be a single use or rechargeable accumulator, possibly based on at least one electrochemical cell.

In an example embodiment, the electric power supply 114 comprises mains electricity 120, i.e., the electromechanical lock 100 may be coupled to the general-purpose alternating-current electric power supply, either directly or through a voltage transformer.

In an example embodiment, the electric power supply 114 comprises an energy harvesting device 122, such as a solar cell that converts the energy of light directly into electricity by the photovoltaic effect.

In an example embodiment, the electric energy 160 required by the actuator 103 and the electronic circuit 112 is sporadically imported from some external source 130.

In an example embodiment, the external source 130 comprises a remote control system 132 coupled in a wired or wireless fashion with the electronic circuit 112 and the actuator 103.

In an example embodiment, the external source 130 comprises NFC (Near Field Communication) technology 136 containing also the data 162, i.e., a smartphone or some other user terminal holds the data 162. NFC is a set of standards for smartphones and similar devices to establish radio communication with each other by touching them together or bringing them into close proximity. In an example embodiment, the NFC technology 136 may be utilized to provide 160 the electric energy for the actuator 103 and the electronic circuit 112. In an example embodiment, the smartphone or other portable electronic device 136 creates an electromagnetic field around it and an NFC tag embedded in electromechanical lock 100 is charged by that field. Alternatively, an antenna with an energy harvesting circuit embedded in the electromechanical lock 100 is charged by that field, and the charge powers the electronic circuit 112, which emulates NFC traffic towards the portable electronic device 136.

In an example embodiment, the external source 130 comprises the key 134 containing the data 120, stored and transferred by suitable techniques (for example: encryption, RFID, iButton® etc.).

As shown in FIG. 1, in an example embodiment, the electromechanical lock 100 may be placed in a lock body 102, and the access control mechanism 104 may control 154 a latch (or a lock bolt) 126 moving in 156 and out (of a door fitted with the electromechanical lock 100, for example).

In an example embodiment, the lock body 102 is implemented as a lock cylinder, which may be configured to interact with a latch mechanism 124 operating the latch 126.

In an example embodiment, the actuator 103, the access control mechanism 104 and the electronic circuit 112 may be placed inside the lock cylinder 102.

Although not illustrated in FIG. 1, the generator 116 may be placed inside the lock cylinder 102 as well.

Let us study FIGS. 6A, 6B, 6C, 7A, 7B and 7C in more detail.

In an example embodiment, the actuator 103 also comprises a moving shaft 510 coupled with the drive head 109. In the shown example embodiments, the moving shaft 510 is a rotating shaft.

In an example embodiment, the actuator 103 comprises a transducer 602 that accepts electric energy and produces the kinetic motion for the moving shaft 510. In an example embodiment, the transducer 602 is an electric motor, which is an electrical machine that converts electrical energy into mechanical energy. In an example embodiment, the transducer 602 is a stepper motor, which may be capable of producing precise rotations. In an example embodiment, the transducer 602 is a solenoid, such as an electromechanical solenoid converting electrical energy into the kinetic motion.

In an example embodiment, the electromechanical lock 100 comprises the lock body 102, a first axle 600 configured to receive the rotation 152 from the user, the transducer 602, a part 604 accommodating the driven gear 101, the drive head 109, and a second axle 606 permanently coupled with the latch mechanism 124. In our example embodiment, the rotation 152 by the user is transmitted, in the unlocked position 400 of the actuator 103 through the turning of the first axle 600 in unison with the second axle 606 to the latch mechanism 124 withdrawing 156 the latch 126. However, a "reversed" example embodiment is also feasible: the first axle 600 may be permanently coupled with the latch mechanism 124 and the second axle 606 may be configured to receive the rotation 152 by the user. If we apply this alternate example embodiment to the FIG. 1, this means that the knob 106 (or the key 134 in the keyway 108, or the handle 110) rotates freely in the locked position 260 of the actuator 103, whereas the backend 606 is blocked to rotate, and, in the open position 400 of the actuator 103, the backend 606 is released to rotate and the first axle 600 and the second axle 606 are coupled together.

Now that the general structure of the electromechanical lock 100 has been described, let us next study its operation with reference FIGS. 2, 3A, 3B, 3C, 3D, 4A and 4B.

FIGS. 2, 3A, 3B, 3C and 3D illustrate that even if the external mechanical break-in force 172 is applied from outside of the electromechanical lock 100, the drive head

109 remains stationary by at least one of the pins 210, 212 contacting at least one of the cogs 220, 222, 224, and by the grip mechanism 111 holding the driven gear 101 stationary in the locked position 200.

In FIG. 2, the driven gear 101 is in the locked position 200, wherein the two pins 210, 212 of the drive head 109 are on both sides of the cog 220 of the driven gear 101. In this position, the external mechanical break-in force 172 cannot cause moving of the driven gear 101. This is because the grip mechanism 111, 240, 242 holds the driven gear 101 stationary. Also, the shape of the cog 220 is such that the drive head 109 cannot exert sufficient force to the driven gear 101 so that it would move.

Figure 3C:
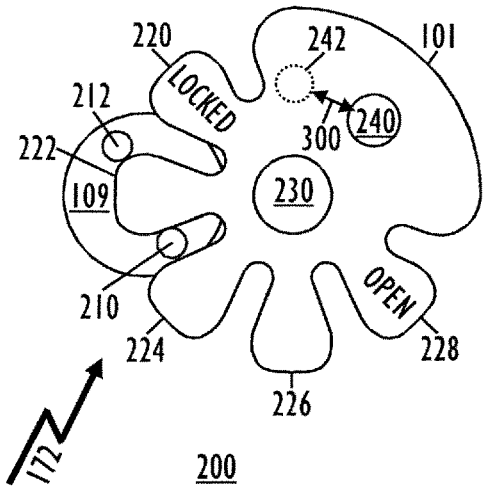
Figure 3D:
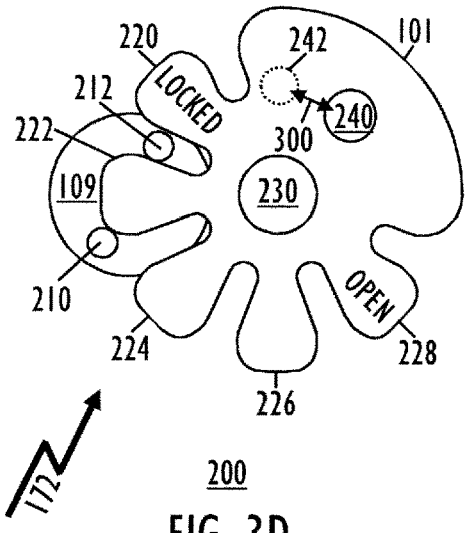

FIG. 3A illustrates a situation wherein the external mechanical break-in force 172 has managed to rotate the drive head 109 so that the two pins 210, 212 are now on both sides of the cog 222. Still, the grip mechanism 111 (in our example embodiment, the magnetic field forces 300 between the two permanent magnets 240, 242) attempts to hold the driven gear 101 stationary. As shown in detail in FIG. 3B, the two pins 210, 212 are on an arched surface 300 of the cog 222. The drive head 109 may turn and its pins 210, 212 may move over this arched surface 300, but it cannot apply sufficient force to the driven gear 101, whereby the driven gear 101 remains stationary. FIGS. 3C and 3D show that even at these extreme positions the drive head 109 still cannot turn the driven gear 101. In an example embodiment, the shape of each cog 220, 222, 224, 226, 228 is such that it has an arched surface 300 on both sides, ending to a planar (not pointed) tip.

With the structure of the driven gear 101 of FIG. 2, the drive head 109 must rotate at least two full rotations in order to rotate the driven gear 101 from the locked position 200 to the open position 400. It may be even more, as the driven gear 101 may be configured to be in the locked position 200 so that the pin 210 is driven to the bottom of the first notch adjacent to the first cog 220, and in the open position 400 so that the pin 212 is driven to the bottom of the last notch adjacent to the last cog 228. With the structure of the driven gear 101 of FIG. 5, the break-in security may be improved even more, supposing that the driven gear 101 must rotate one full rotation, or even a plurality of rotations, before the lock mechanics are arranged into such an order that the rotation 152 causes the retraction 156 of the latch 126.

Figure 4A:
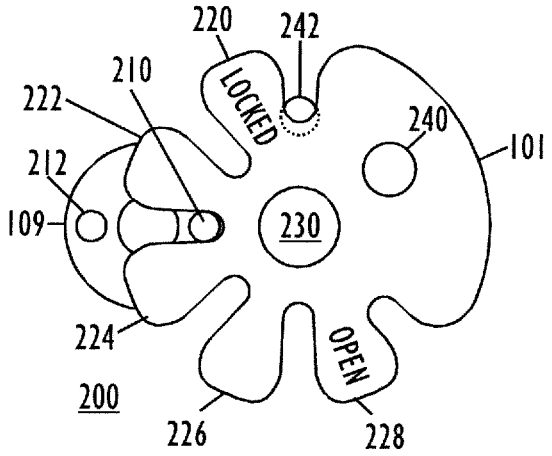
Figure 4B:
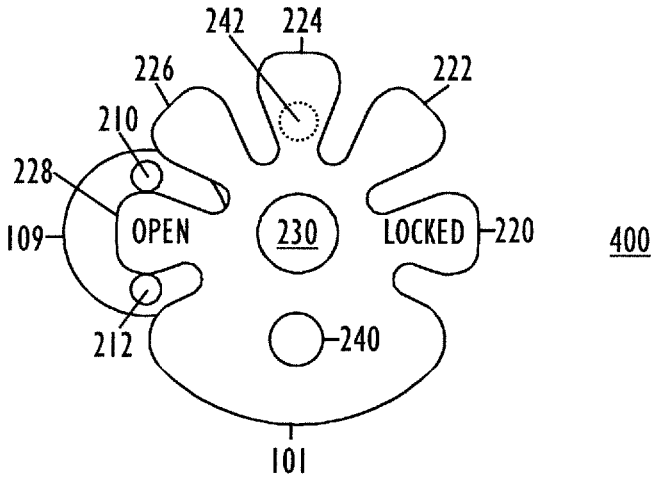

FIGS. 4A and 4B illustrate that, provided that the data 162 matches the predetermined criterion, the drive head 109 rotates the driven gear 101 to the open position 400, by the two pins 210, 212 driving the cogs 220, 222, 224, 226, 228 and overcoming the grip mechanism 111, and thereby setting the access control mechanism 104 to be rotatable 152 by the user.

As shown in FIGS. 4A and 4B, when the drive head 109 is authorized to rotate with the electric power 160, the driven gear 101 is rotated to the open position 400 efficiently.

It will be obvious to a person skilled in the art that, as technology advances, the inventive concept can be implemented in various ways. The invention and its embodiments are not limited to the example embodiments described above but may vary within the scope of the claims.

The invention claimed is:

1. An electromechanical lock comprising:

an electronic circuit configured to read data from an external source and match the data against a predetermined criterion;

an actuator comprising a drive head rotatable by electric power; and an access control mechanism comprising a driven gear with cogs, and a grip mechanism holding the driven gear stationary in a locked position;

wherein the drive head comprises two pins configured and positioned so that one of the pins is in a notch between two cogs of the driven gear, and, provided that the data matches the predetermined criterion, the drive head rotates the driven gear to an open position, by the two pins driving the cogs and overcoming the grip mechanism, and thereby setting the access control mechanism to be rotatable by a user, or, if an external mechanical break-in force is applied from outside of the electromechanical lock, the drive head remains stationary by at least one of the pins contacting at least one of the cogs, and by the grip mechanism holding the driven gear stationary in the locked position.

2. The electromechanical lock of claim 1, wherein the cogs cover a limited sector less than 360 degrees of the driven gear, and the actuator is configured to rotate the drive head from the locked position to the open position so that the drive head rotates the driven gear from one end of the limited sector to the other end of the limited sector.

3. The electromechanical lock of claim 1, wherein the cogs cover 360 degrees of the driven gear, and the actuator is configured to rotate the drive head from the locked position to the open position so that the drive head rotates the driven gear one or more times around the 360 degrees.

4. The electromechanical lock of claim 1, wherein the grip mechanism comprises one or more permanent magnets attached to the driven gear, and one or more counterpart permanent magnets attached to an immovable part of the electromechanical lock, and the overcoming of the grip mechanism comprises overcoming the magnetic field forces between the one or more permanent magnets and the one or more counterpart permanent magnets.

* * * * *